United States Patent [19]

Polonsky

[11] 4,307,460

[45] Dec. 22, 1981

[54] ELECTRONIC DIGITAL ALARM CLOCK

[75] Inventor: Samuel Polonsky, Monroe, Conn.

[73] Assignee: General Electric Company, New York, N.Y.

[21] Appl. No.: 82,863

[22] Filed: Oct. 9, 1979

[51] Int. Cl.[3] ..... G04B 23/02

[52] U.S. Cl. ..... 368/74; 368/263

[58] Field of Search ..... 58/16 R, 16 D, 57.5; 200/5 R, 16 D, 60, 243, 246, 252, 254, 259, 260; 362/109, 157, 196, 208, 202, 205; 368/72-74, 250, 251, 262, 263, 320-321

[56] References Cited

U.S. PATENT DOCUMENTS

| | | | |
|---|---|---|---|
| 1,598,666 | 9/1926 | Voorhees | 362/205 X |
| 2,908,827 | 10/1959 | Hickman | 200/16 D |
| 3,222,467 | 12/1965 | Meyer | 200/16 D |
| 3,784,765 | 1/1974 | Daly | 200/16 D X |
| 4,025,743 | 5/1977 | Oswald | 200/60 |
| 4,228,645 | 10/1980 | Nomura | 368/250 X |

*Primary Examiner*—Vit W. Miska

*Attorney, Agent, or Firm*—Leonard J. Platt; George R. Powers; John F. Cullen

[57] ABSTRACT

An electronic digital alarm clock wherein a unique combination switch functions as an on/off switch for permitting or preventing an alarm from sounding and a momentary repeat alarm switch for temporarily shutting off the alarm for a short interval of time. A single switch actuator is provided for controlling both the alarm on/off switch and the repeat alarm switch. The actuator is guided for longitudinal movement for controlling the on/off switch and the actuator is also guided for inward and outward movement for controlling the momentary repeat alarm switch.

6 Claims, 7 Drawing Figures

ELECTRONIC DIGITAL ALARM CLOCK

BACKGROUND OF THE INVENTION

1. Field of the Invention

This invention relates to an electronic digital clock, and more particularly, to a switch and switch actuator for controlling an alarm and a repeat alarm of such a clock.

2. Description of the Prior Art

In electronic digital alarm clocks it has been common practice to mount all of the electronic components of the clock on a printed circuit board. Conventionally, a single pole double throw on/off switch is provided for setting the alarm for operation at a preset time. When the switch is moved to its on position the alarm is set to sound at the preset time and when the switch is in its off position the alarm is prevented from sounding at the preset time. It is also conventional to provide a momentary single pole single throw switch for temporarily shutting off the alarm for a short time interval. In all of the prior art constructions separate switch actuators and switches are required for controlling the on/off switch and the repeat alarm momentary contact switch.

In a prior Snooz-Alarm electronic digital alarm clock, model number 8143-503, manufactured by the assignee of the instant invention a single pole double throw on/off switch and a switch actuator is located at the rear of the clock for setting the alarm to sound at a preset time and a separate momentary contact repeat alarm switch and switch actuator is located at the top wall of the clock for controlling the repeat alarm.

This invention is concerned with an electronic clock such as the model 8143 clock, and more particularly, to a unique actuator and switch construction so that a single actuator may be used for controlling an alarm switch and temporary repeat alarm switch.

Accordingly, it is the primary object of my invention to provide an improved alarm and repeat alarm switch construction which may be readily and conveniently operated.

It is a further object of my invention to provide an improved alarm and temporary alarm actuator and switch that is ruggedly constructed of relatively few parts which may be readily manufactured and assembled to each other.

SUMMARY OF THE INVENTION

In accordance with one of the aspects of this invention, an alarm clock includes an alarm circuit for sounding an audible alarm at a preset time and an on/off switch located in the alarm circuit for permitting or preventing the sounding of the audible alarm at the preset time. A momentary contact switch is also located in the alarm circuit for temporarily shutting off the alarm for a short interval of time after the alarm has sounded. A single switch actuator is provided for controlling both the on/off switch and the momentary contact switch for the repeat alarm. The switch actuator is guided for longitudinal movement in one direction and in a direction opposite to the one direction for moving the on/off switch for permitting the sounding of the alarm at the preset time when the actuator has been moved to the switch ON position. The actuator is also related to the on/off switch so that when the switch actuator is moved longitudinally to the switch OFF position, the on/off switch is actuated to its OFF position to prevent the sounding of the alarm at the preset time. The single switch actuator is also guided for inward and outward movement in a direction generally perpendicular to its longitudinal movement for actuating the momentary contact switch by a pushing action in order to momentarily close the switch in order to temporarily shut off the alarm for a short interval of time.

With this unique simplified construction both the main alarm and the repeat alarm may be readily and conveniently operated by movement of a single switch actuator.

BRIEF DESCRIPTION OF THE DRAWING

Other objects and attendant advantages of the invention will be apparent from the following description taken in connection with the accompanying drawing in which.

DESCRIPTION OF PREFERRED EMBODIMENT

Figure 7:
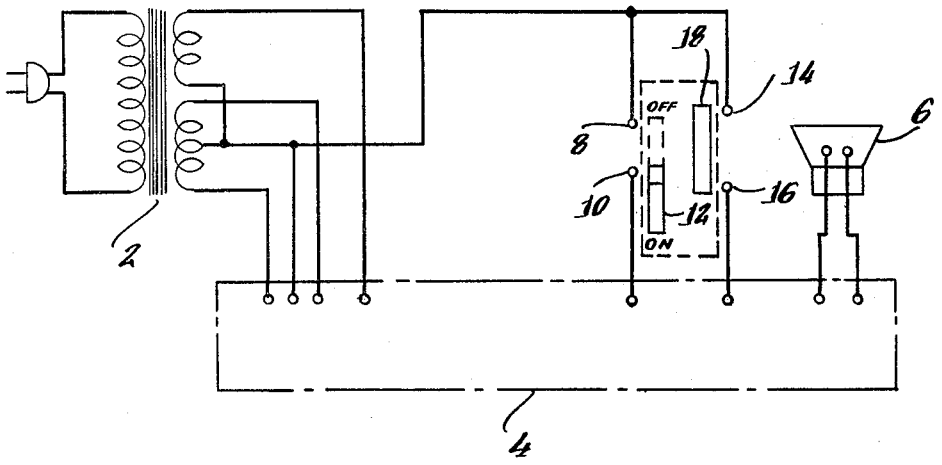
FIG. 7 is a circuit diagram of an electronic clock circuit including my improved combined alarm on/off switch and momentary contact repeat alarm switch for temporarily shutting off the alarm for a short interval of time after the alarm has been actuated.

Referring now to the drawing and first particularly to FIG. 7, there is shown a circuit diagram of an electronic digital alarm clock which may include my unique combined alarm on/off switch and momentary contact repeat alarm switch for temporarily shutting off the alarm for a short interval of time after it has sounded. The alarm circuit may include a transformer 2 for steeping down a 110-volt household power supply, and a circuit board 4 for mounting an integrated circuit for counting and displaying time and the other circuitry of an electronic alarm clock. Conventionally a sounder 6 is suitably connected to circuit board to the function as an audible alarm when the alarm is actuated at a preset time.

It is also a common practice to connect an alarm on/off switch and a temporary alarm shut off switch in the electronic alarm clock circuit for setting the alarm to sound at a preset time and for momentarily shutting off the alarm for a short interval of time after the alarm has sounded. As shown, the alarm on/off switch includes fixed contacts 8 and 10, and a contact slider 12 which may be moved from the alarm on position illustrated in FIG. 7 to the alarm off position illustrated by the dotted lines in FIG. 7. It is to be noted that in the embodiment illustrated, the alarm is in the ON position and is set to be sounded at a preset time and when the contacts 8 and 10 are open. When the slider 12 is moved upwardly as viewed in FIG. 7 to close the contacts 8–10, the alarm is in the "off" position.

The repeat alarm switch for temporarily shutting off the alarm for a short interval of time after the alarm has been sounded includes fixed contacts 14 and 16, and a momentary push button contact 18 for momentarily closing contacts 14, 16, and 18 to actuate the repeat alarm to shut off the alarm for a short interval of time.

As shown in FIG. 7, contact 8 of the alarm on/off switch 8, 10, and 12 and contact 14 of the repeat alarm switch 14, 16 and 18 are connected to a common line which is connected to one portion of the transformer 2. The other fixed contacts 10 and 16 of the on/off switch and momentary contact switch are connected through the circuitry on the circuit board, 4 with the other side of the transformer 2 in a conventional manner.

The separate alarm on/off switch 8, 10 and 12, the separate repeat alarm switch 14, 16 and 18, and the circuitry alarm in FIG. 7 are used in a prior art, SNOOZ-ALARM electronic digital alarm clock, model number 8143-503 manufactured by the assignee of the instant invention.

Figure 1:
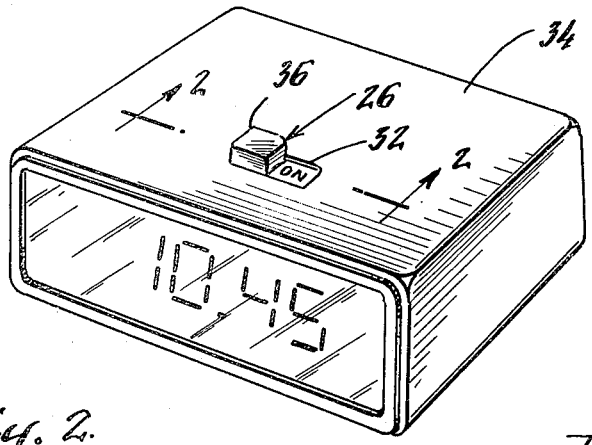
FIG. 1 is a front perspective view of a digital alarm clock embodying a combined alarm on/off switch and repeat alarm switch constructed in accordance with my invention.
Figure 2:
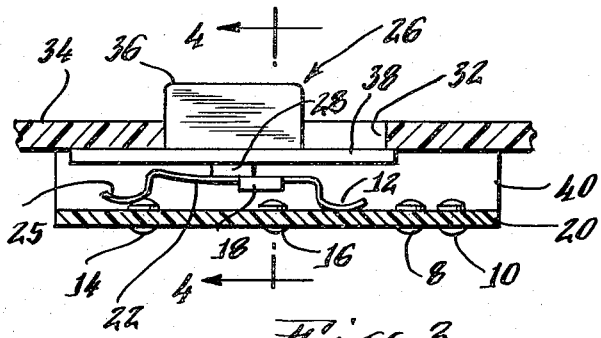
FIG. 2 is a fragmentary cross-sectional view of the switch illustrated in FIG. 1 taken along the line of 2—2 of FIG. 1 showing the alarm on/off switch in the ON position for permitting the alarm to be sounded at the preset time.
Figure 4:
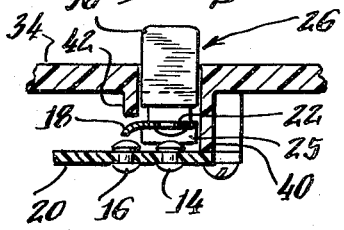
FIG. 4 is a fragmentary cross-sectional view of the combined alarm on/off and temporary repeat alarm momentary contact switch taken along the line 4—4 of FIG. 2 showing the momentary contact repeat alarm switch in the open, off position.
Figure 3:
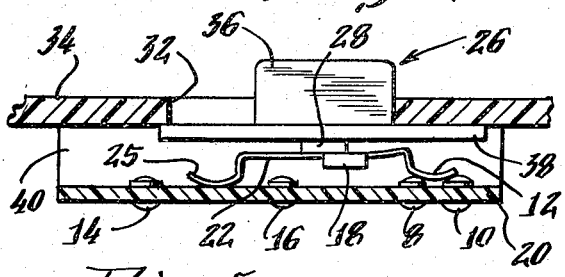
FIG. 3 is a fragmentary cross-sectional view of the the combined alarm on/off switch and repeat alarm momentary contact switch showing the on/off switch contacts in the closed position wherein the alarm set switch is in the OFF position to prevent the alarm from sounding at the preset time.
Figure 6:
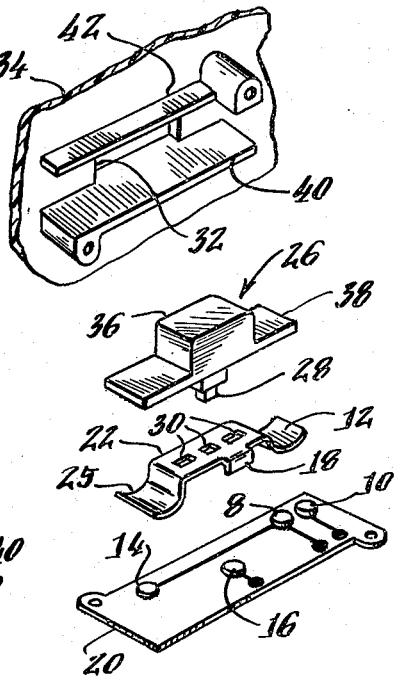
FIG. 6 is a fragmentary, exploded perspective view of the combined alarm on/off and temporary repeat alarm switch illustrated in FIG. 2.

In accordance with my invention, the alarm on/off switch 8, 10, and 12, and the repeat alarm switch 14, 16, and 18 are uniquely constructed and arranged with respect to each so that they may be controlled by a single actuator. As shown more particularly in the exploded perspective view of FIG. 6, the fixed switch contacts 8 and 10 of the alarm on/off switch 8, 10, 12 and the fixed switch contacts 14 and 16 of the repeat alarm switch may be mounted on a common terminal board 20. As shown in FIGS. 2–4, the contacts 8, 10, 14, and 16 may be in the form of rivets which extend through the terminal board and extend upwardly from the board so that they may be engaged by a single combined shiftable contactor 12, 18. Considering FIG. 6 with FIG. 7, it can be appreciated that the contacts 8 and 14 are connected to a common line while contacts 10 and 16 are connected with separate leads to the printed circuit board 4 of the electronic alarm clock circuit.

The shiftable contactor 12–18 for closing the on/off alarm switch contacts 8–10, and momentarily closing the repeat alarm switch contacts 14 and 16, may be readily formed from a piece of sheet-spring metal. As shown, the contactor includes a flat horizontal bridge portion 22, a downwardly extending momentary connect position 18 and two resilient spring fingers 12 and 25 for normally holding the momentary repeat alarm switch contact 18 above its mating fixed contact 16. The spring finger 12 also uniquely functions as a slideable contact for the on/off 8,10 switch, while spring finger 25 cooperates with contact 14 to complete a circuit when contact 18 of the repeat alarm switch is depressed to engage contact 16.

Both the alarm on/off switch and the repeat alarm switch may be operated by a manually operable switch actuator 26 which is preferably formed from plastic or other insulated material. The actuator 26 may be readily connected to the shiftable contactor 12–18 by means of a depending lug 28 that may be passed through an aperture 30 in the bridge portion of the shiftable actuator and then peened over. The actuator 26 is supported for both longitudinal movement for controlling operation of the on/off switch 12 and inward and outward movement for actuating the repeat alarm momentary contact switch 18. As shown, the alarm clock housing is provided with a generally rectangular aperture 32 in its upper wall 34 for receiving an outwardly extending portion 36 of the actuator 26. The actuator 26 also includes a generally rectangular slider 38 which may be suitably positioned between guide walls 40 and 42 that are formed on the underside of the top wall of the clock.

With this unique construction, it can be appreciated that the alarm on/off switch may be readily moved from its off position to its on position and vice-versa by manually moving the button 26 to slide the portion 34 between the walls 40 and 42. When the actuator 26 is slid to the alarm ON position illustrated in FIG. 2, the switch contacts 8, 10, and 16 are in their open position and the alarm clock circuit is set so that the alarm will sound. When the slide 26 is moved to the right as shown in FIG. 3 to the alarm OFF position, the shiftable contact 12 is moved to close contacts 8 and 10, and the alarm on/off switch is set to prevent the alarm from sounding at a preset time.

Figure 5:
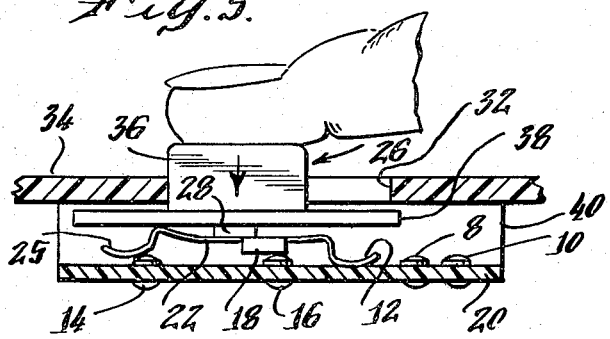
FIG. 5 is a fragmentary cross-sectional view of the combined alarm on/off switch and the momentary contact repeat alarm switch generally similar to FIG. 2 showing the switch actuator being depressed with the momentary contact repeat alarm switch closed to momentarily actuate the repeat alarm to shut off the alarm and allow the alarm to sound again after a short interval of time.

With the switch contacts in the alarm ON position illustrated in FIG. 2 and after the alarm has started to sound at the preset alarm time, the actuator 26 may be depressed as shown in FIG. 5 to momentarily connect contact 18 with contact 14 in order to temporarily shut off the alarm for a short interval of time. It can be appreciated that when finger pressure is removed from the actuator 26, the resilient spring fingers 12–25 of the shiftable contactor will return the contactor 18 upwardly to its normal position to open the contacts 18–16. From the foregoing discussion, it can be appreciated that my improved combined alarm on/off switch and repeat alarm switch may be readily constructed with relatively few parts. The principal component is a unique shiftable contactor 12–18 that includes two spring fingers 12 and 25 for holding the momentary repeat alarm contact 18 above the fixed repeat alarm contact 16. The same spring fingers 12 and 25 are also utilized for closing the alarm on/off switch contacts 8 and 10. Thus, an exceedingly reliable mechanism is achieved by the use of relatively few parts.

It can also be appreciated that my unique mechanism may be readily and conveniently operated. All that is necessary to set the alarm is to move the actuator 26 horizontally from one position to another position, and in order to temporarily shut off the alarm the same actuator is moved downwardly.

While there has been shown and described a particular embodiment of the invention, it will be obvious to those skilled in the art that various changes and modifications can be made herein without departing from the invention. For example, in the alarm clock circuit illustrated in FIG. 7, the alarm ON/OFF switch is in the alarm ON position and the alarm is set to be actuated at a preset time when the switch contacts 8 and 10 are opened, and the ON/OFF switch is in the OFF position and the alarm is prevented from sounding when the switch contacts 8 and 10 are closed. In other electronic alarm clock circuits, an alarm ON/OFF switch may be moved to its ON position and set to be actuated by closing a pair of switch contacts. Clearly my improved combination switch construction may be readily used or modified by one skilled in the art so that it will function equally as well in an electronic clock circuit environment wherein switch contacts are closed for turning an alarm ON and opened for turning an alarm OFF. Therefore, it is aimed in the appended claims to cover all such changes and modifications that fall within the true spirit and scope of the invention.

I claim:

1. In an electronic alarm clock having a housing wherein an alarm circuit is provided for sounding an audible alarm at a preset time, an on/off switch is located in the alarm circuit for permitting or preventing the audible alarm from sounding at the preset time and a momentary contact repeat alarm is also located in said alarm circuit for temporarily shutting off the alarm for a short time interval after the alarm has been actuated at a preset time, the improvement comprising:

(a) a single switch actuator extending through an opening in said housing for controlling said on/off switch and said momentary contact repeat alarm switch;

(b) means for guiding said switch actuator for longitudinal movement in one direction and in a direction opposite to said one direction to permit the actuator to be moved longitudinally in said one direction to actuate the on/off switch to its ON position for sounding the alarm at the preset time and to permit the actuator to be moved longitudinally in the opposite direction to actuate the on/off switch to its OFF position to prevent sounding the alarm at the preset time;

(c) said switch actuator also being guided for inward and outward movement in a direction generally perpendicular to said one direction for actuating said momentary contact repeat alarm switch by pushing action to momentarily close the momentary contact switch in order to temporarily shut off the alarm for a short interval of time when the alarm is sounding at a preset time by pushing the actuator in a direction perpendicular to said one direction whereby a single actuator is provided for effectively controlling the operation of an on/off switch and momentary contact repeat alarm switch in the alarm circuit of said alarm clock.

2. An electronic alarm clock as defined in claim 1 wherein:

a shiftable metal contactor plate is connected to said switch actuator for actuation thereby and said metal contactor plate includes a first contact portion for closing and opening the on/off switch and a second portion for closing the momentary contact switch, said first contact portion being actuated by movement of the switch actuator in a longitudinal direction and the second contact portion being actuated by movement of said actuator in a direction perpendicular to said longitudinal direction.

3. An alarm clock comprising:

(a) an alarm circuit for sounding an audible alarm at a preset time;

(b) an on/off switch located in said alarm circuit for permitting or preventing said audible alarm from sounding at said preset time;

(c) a momentary repeat alarm switch located in said alarm circuit for temporarily shutting off the alarm for a short interval of time when the alarm is sounding at said preset time;

(d) a single switch actuator for controlling said on/off switch and said momentary switch;

(e) first means for guiding said switch actuator for longitudinal movement in one direction and in a direction opposite to said one direction for causing said on/off switch to assume its ON position for permitting the sounding of said alarm at said preset time when the actuator has been moved in said one direction to the switch ON position for causing said on/off switch to assume its off position to prevent the sounding of said alarm at said preset time when said switch actuator is moved in the opposite direction;

(f) second means for guiding said switch actuator for inward and outward movement in a direction generally perpendicular to said one direction for actuating said momentary repeat alarm switch by a pushing action to momentarily close the repeat alarm switch in order to temporarily shut off the alarm for a short interval of time when the alarm is sounding at said preset time by pushing the actuator in a direction perpendicular to said one direction whereby a single actuator is provided for effectively controlling the operation of an on/off switch and a momentary contact repeat alarm switch in the alarm circuit of said alarm clock.

4. In an electronic alarm clock wherein an alarm circuit is provided for sounding an audible alarm at a preset time, an on/off switch is located in the alarm circuit for permitting or preventing the audible alarm from sounding at the preset time and a momentary contact repeat alarm switch is also located in said alarm circuit for temporarily shutting off the alarm for a short time interval after the alarm has been actuated at a preset time, the improvement comprising:

(a) a clock casing having a wall formed of insulating material having a slot formed therein;

(b) a switch actuator extending through said slot;

(c) a terminal board having a pair of on/off switch contacts and a pair of fixed repeat alarm momentary switch contacts positioned inwardly from said clock casing wall;

(d) a shiftable metal switch contactor connected to said actuator for actuation thereby, said contactor having a first contact portion for closing and opening said pair of on/off switch contacts in order to set the alarm for operation at a preset time, and said contactor having a second contact portion for momentarily closing said repeat alarm switch contacts to shut off the alarm for a short interval of time whereby a single actuator is provided for controlling the operation of an on/off switch and a momentary contact switch in the alarm circuit of said alarm clock.

5. An electronic alarm clock as defined in claim 4 wherein the shiftable metal switch contactor includes a generally horizontal bridge portion for connection to said actuator two spring contact portions on opposite sides of said bridge portion, one of said spring contact portions being arranged to open and close the on/off switch, and a momentary switch contact portion positioned between said spring contact portions, said spring contact portions extending downwardly for a greater distance than the momentary switch contact portion in order to hold the momentary switch contact portion above the other switch contact of said momentary repeat alarm switch.

6. In an electronic alarm clock wherein an alarm circuit is providing for sounding an audible alarm at a preset time, an on/off switch is located in the alarm circuit for permitting or preventing the audible alarm from sounding at the preset time and a momentary contact repeat alarm switch is also located in said alarm circuit for temporarily shutting off the alarm for a short time interval after the alarm has been actuated at a preset time, the improvement comprising:

(a) a clock casing having a wall formed of insulating material having a slot formed therein;

(b) a switch actuator extending through said slot;

(c) a terminal board having a pair of on/off switch contacts and a pair of fixed repeat alarm momentary switch contacts positioned inwardly from said clock casing wall;

(d) a shiftable metal switch contactor connected to said actuator for actuation thereby, said contactor having a first contact portion for closing and opening said pair of on/off switch contacts in order to set the alarm for operation at a preset time, and said contactor having a second contact portion for momentarily closing said repeat alarm switch contacts to shut off the alarm for a short interval of time;

(e) first means for guiding said switch actuator for longitudinal movement in one direction and in a direction opposite to said one direction to permit the actuator to be moved longitudinally in said one direction to move the on/off switch to its ON position for sounding the alarm at the preset time and to permit the actuator to be moved longitudinally in the opposite direction to move the on/off switch to its OFF position to prevent sounding the alarm at the preset time;

(f) second means for guiding said switch actuator for inward and outward movement in a direction generally perpendicular to said one direction for actuating said momentary switch by a pushing action to momentarily close the momentary contact switch in order to temporarily shut off the alarm for a short interval of time when the alarm is sounding at said preset time by pushing the actuator in a direction perpendicular to said one direction whereby a single actuator is provided for effectively controlling the operation of an on/off switch and a momentary contact repeat alarm switch in the alarm circuit of said alarm clock.

* * * * *